US006708842B2

(12) United States Patent
Peter

(10) Patent No.: US 6,708,842 B2
(45) Date of Patent: Mar. 23, 2004

(54) METHOD AND DEVICE FOR UNPACKING A STACK IN A SLEEVE

(75) Inventor: Erwin Peter, Deventer (NL)

(73) Assignee: Can Systems Worldwide B.V., Deventer (NL)

( * ) Notice: Subject to any disclaimer, the term of this patent is extended or adjusted under 35 U.S.C. 154(b) by 0 days.

(21) Appl. No.: 10/148,524

(22) PCT Filed: Dec. 1, 2000

(86) PCT No.: PCT/NL00/00885

§ 371 (c)(1),
(2), (4) Date: Oct. 2, 2002

(87) PCT Pub. No.: WO01/40059

PCT Pub. Date: Jun. 7, 2001

(65) Prior Publication Data

US 2003/0057218 A1 Mar. 27, 2003

(30) Foreign Application Priority Data

Dec. 2, 1999 (NL) ..... 1013723

(51) Int. Cl.[7] ..... B65G 59/00

(52) U.S. Cl. ..... 221/68; 53/157

(58) Field of Search ..... 221/1, 67, 68, 221/26, 103, 175; 53/443, 445, 147, 157

(56) References Cited

U.S. PATENT DOCUMENTS 4,852,253 A 8/1989 Uchida
2003/0056471 A1 * 3/2003 Linkev, II et al. ..... 53/445

FOREIGN PATENT DOCUMENTS

EP 0 947 428 A1 10/1999

* cited by examiner

*Primary Examiner*—Kenneth W. Noland
(74) *Attorney, Agent, or Firm*—Webb Ziesenheim Logsdon Orkin & Hanson, P.C.

(57) ABSTRACT

The invention relates to a method and device for unpacking a stack of products packaged in a sleeve, such as a stack of covers for cans, for instance drink cans, having the steps of removing a portion of the sleeve located on a longitudinal end; peeling away the sleeve over the stack with a relative movement of the stack and the sleeve; and separately discharging the stack without the sleeve.

25 Claims, 5 Drawing Sheets

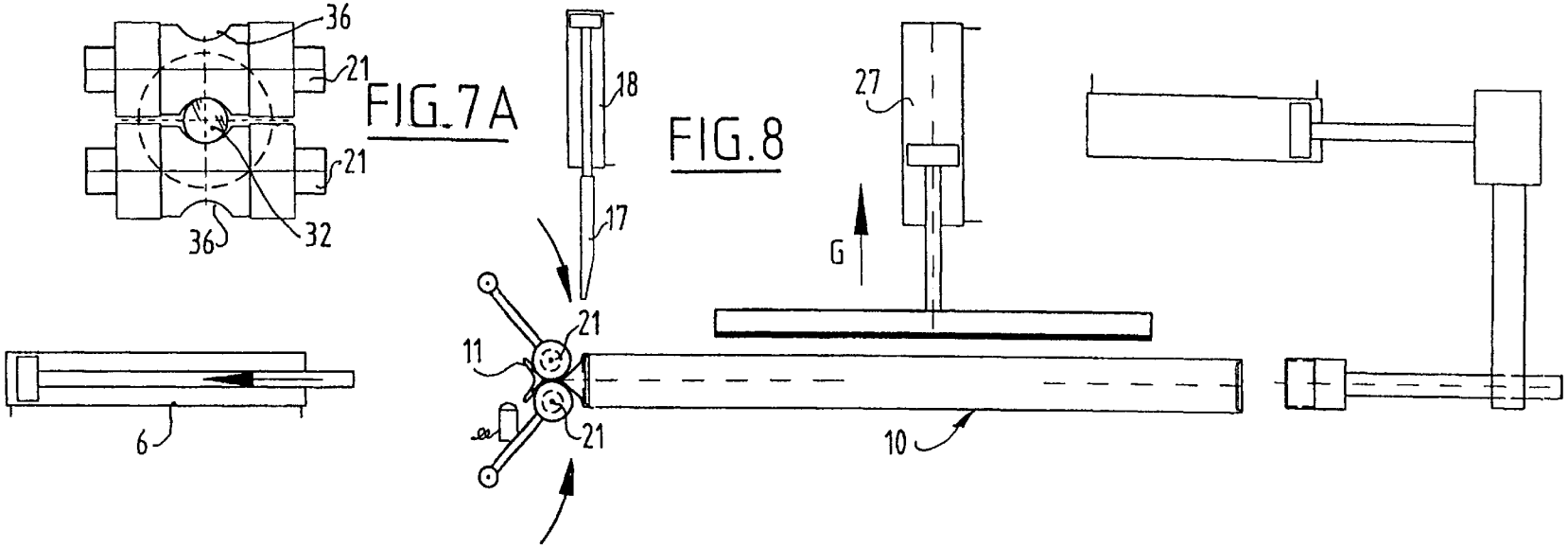
FIG.8
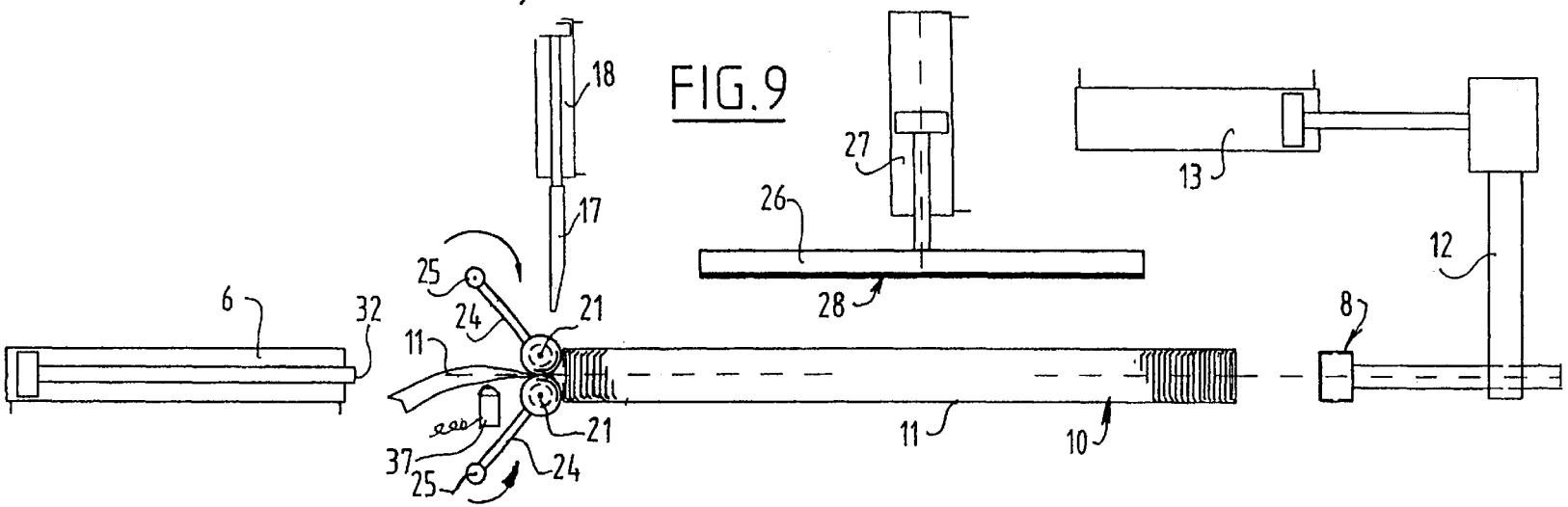
FIG.9
FIG.7A

METHOD AND DEVICE FOR UNPACKING A STACK IN A SLEEVE

BACKGROUND OF THE INVENTION

1. Field of the Invention

The present invention relates to a method and a device for unpacking a stack of products packaged in a sleeve, such as a stack of covers for cans, for instance drinks cans.

2. Description of the Related Art

In the production of drinks cans the body of the can is usually punched, while after filling with the contents the cover is arranged in the filling opening for filling of the drinks can and is fixed there. For this purpose the covers are supplied in stacks which are packed per stack in a sleeve, for instance of paper. It is noted that the present invention is not limited to stacks of covers for drinks cans, but is applicable in the unpacking of all types of products packed in a sleeve which are stacked in the sleeve.

It is generally known to manually remove the sleeve from the stack of products. For this purpose a longitudinal cut, either linear or helical, is made in the packaging-like sleeve. The stack is then removed from the packaging and placed on a conveyor belt for further processing. This manual work is time-consuming and cannot usually be performed rapidly enough to keep up with the devices which process the products. In addition, the work is stultifying and can easily lead to mistakes, wherein the stack of products is set down the wrong way round and then presented the wrong way round to the device for further processing of the products, which can hereby jam.

Automated solutions are known, which are however all based on cutting through the sleeve in axial direction—linearly or helically—wherein the sleeves with the stacks of products therein must often still be placed manually in the automated unpacking device, which can still result in problems with the orientation of the products in respect of the devices for further processing.

EP-A-0,947,428 relates to a technique of longitudinally cutting the sleeve before discharge of the stacks of products, where the stacks and the associated sleeve are generally relatively long, for which purpose machines have to be used which must have a freedom of movement over correspondingly long distances. Such packaging devices hereby become complex and costly. Damage to the sides of the products can moreover occur with the longitudinal cutting movement in both manual unpacking processes and automated unpacking processes. This is a particular drawback in the case of for instance drinks cans, since it is then not possible to ensure that the finally assembled drinks cans are also made watertight. Damage resulting from the cutting of the sleeve is of course also undesirable in the case of other stacks of products packed in sleeves, precisely because the sleeve itself already serves to protect the stacks of products.

It is acknowledged that from U.S. Pat. No. 4,852,253 a technique is known for automatically unpacking relatively short stacks of coins wrapped in a wrapper.

SUMMARY OF THE INVENTION

The present invention has for its object to obviate the drawbacks of the above described known art, for which purpose a method and a device are provided, which are distinguished respectively by removing and means for removing a part of the sleeve located on a longitudinal end, peeling away the sleeve over the stack with an opposed relative movement of the stack and the sleeve and means for this purpose, and separately discharging the stack and means for this purpose.

Since only the part of the sleeve located at the longitudinal end is removed, the danger of damaging a whole stack of products is obviated. The unpacking process is considerably simplified and automation thereof made appreciably easier in accordance herewith, without exceptionally complex and costly equipment having to be employed for this purpose.

In a preferred embodiment the sleeve is tensioned over the stack on the longitudinal end and a cut is then made in the sleeve at that location. This ensures that the whole or partial removal of the portion of the sleeve located on the longitudinal end takes place accurately, particularly when the sleeve is arranged slightly loosely round the stack of products, as is the case with a paper sleeve. Tensioning of the sleeve can comprise of fixing the sleeve and pushing the stack of products in the fixed sleeve up against the longitudinal end of the sleeve. Use can be made for this purpose of for instance a hydraulic or pneumatic cylinder which presses against the end of the sleeve situated opposite the longitudinal end while the sleeve itself is fixed. This is particularly simple to realize.

The portion of the sleeve located on the longitudinal end can further be wholly or partly removed by perforating the sleeve wholly or partly around the longitudinal end thereof and further relying on pressing of the stack of products out of the sleeve during the relative movement of the stack and the sleeve. This can take place by arranging notches in the sleeve, which is extremely simple to realize, particularly when the sleeve is for instance manufactured from paper. When the products have a form corresponding with the pattern of notches, a safety can be provided which checks alignment of the notch and the recesses before the notches are arranged, and arranging of the notches takes place only when the alignment is correct. A safety is thus provided to prevent the possibility of the stack of products in the sleeve being unpacked the wrong way round and passed on to further processing equipment, with the purpose of preventing disruptions therein. The sleeve can further be fixed and the stack pressed through the radial pattern of notches by pushing up the stack in order to remove the portion on the longitudinal end of the sleeve. The number of cutting operations can hereby be minimized and limited to a minimal depth, whereby further damage to the products can be prevented with certainty. In the interim period between pushing up against the longitudinal end of the sleeve and pushing up through the longitudinal end the sleeve can be released for movement and be displaced in the direction of the end of the sleeve situated opposite the longitudinal end. The movement distance of all moving parts involved in fixing of the sleeve and pushing the stack up to and through the longitudinal end of the sleeve is hereby minimized, for which purpose machines with a small stroke can be used which are simple and relatively inexpensive.

Another embodiment will further be discussed hereinbelow for peeling away the sleeve over the stack of products. A part of the sleeve extending beyond the stack of products is herein engaged with a set of rotatable wheels which can be moved away from and toward each other. When the wheels engage the protruding part of the sleeve, they are driven in rotation in an opposing direction. The sleeve is hereby peeled from the roll of products. The wheels are of course then arranged on the opposite end of the sleeve opposite the removed longitudinal end such that the sleeve is peeled away from the stack by retraction between the wheels. In order to prevent the sleeve being crumpled, the wheels can be intermittently moved respectively away from and toward each other during driving thereof. This ensures that a movement of the sleeve being peeled away is always guaranteed in axial direction of the stack.

BRIEF DESCRIPTION OF THE DRAWINGS

An embodiment, to which the invention is not limited, will be described hereinbelow with reference to the annexed figures, in which:

FIG. 1 shows a schematic perspective view of a device for realizing the method, both according to the present invention;

FIG. 2 shows in enlarged view a detail of the device depicted in FIG. 1; and FIGS. 3–11 show schematic views of the sequence of operations carried out in an embodiment of the method and by an embodiment of the device according to the present invention.

DETAILED DESCRIPTION OF THE INVENTION

Figures 1, 2, 3:
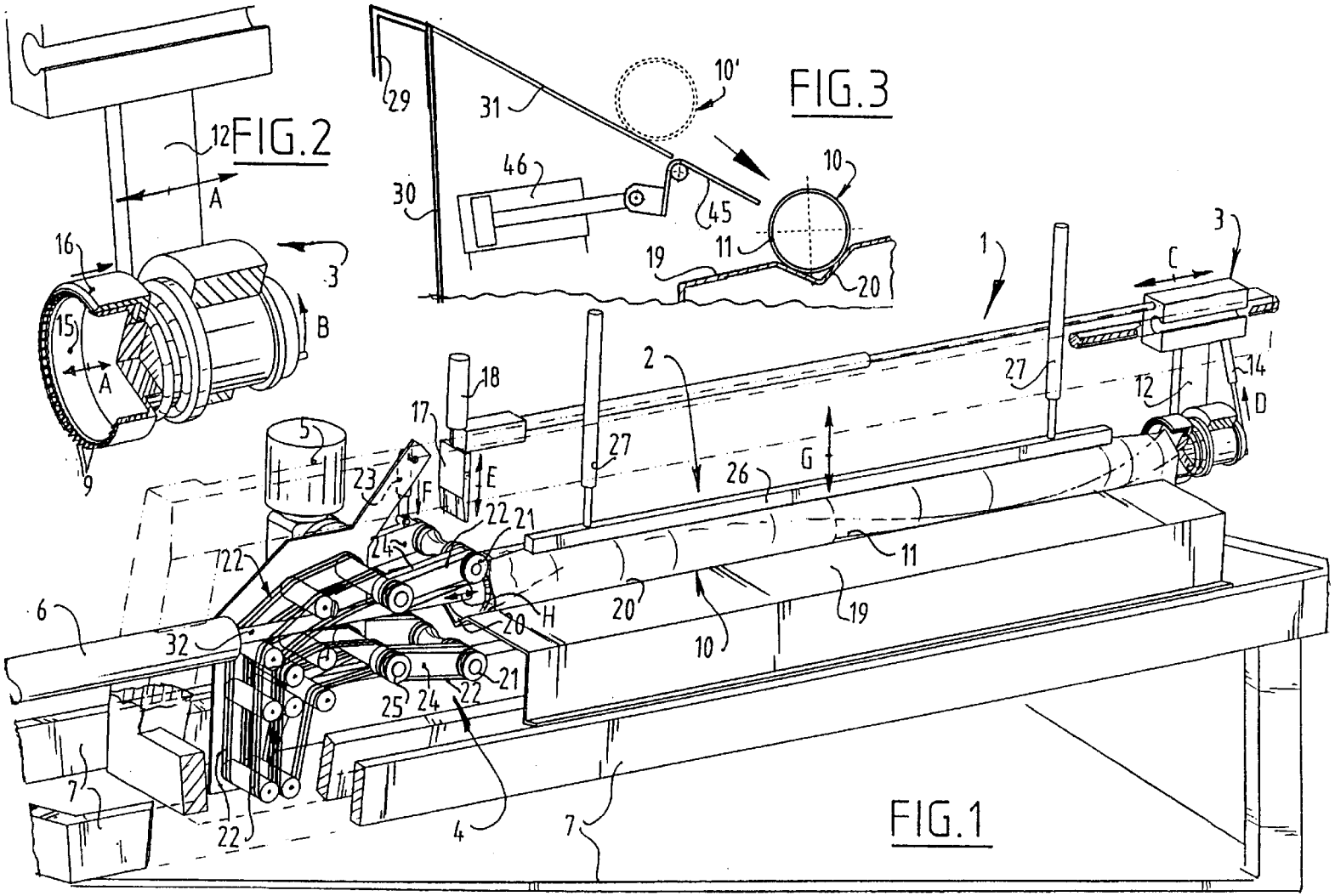

The same or similar components are designated in the different figures with the same reference numerals.

FIG. 1 shows a perspective view of a device 1 according to, and for implementing a method according to the present invention.

Device 1 comprises a frame 7 which is not shown in detail and has thereon a clamp 2, a perforator 3, a peeling unit 4 and a pusher cylinder 6. Peeling unit 4 is driven by motor 5.

Perforator 3 is shown in more detail in FIG. 2, which shows that perforator 3 comprises a head 8 with teeth 9 thereon. Head 8 is linear in the direction of arrow A and rotatably displaceable in the direction of arrow B.

By extending and rotating head 8 in the direction of respectively arrow A and arrow B a paper sleeve 11 of a package 10 having therein for instance a stack of covers for cans, such as drinks cans, can be perforated on a longitudinal end of package 10. With angular displacement in the direction of arrow B over a greater radial distance than that between teeth 9 the relevant longitudinal end of package 10 is completely cut open; an alternative will be discussed hereinbelow.

In the embodiment shown in FIGS. 2 and 1 the head 8 of perforator 3 is suspended from a frame part 12 which is reciprocally displaceable along frame 7 in the direction of arrow C in FIG. 1. A drive cylinder 13 is provided for this purpose. Further shown in FIG. 1 is a rotation-driving cylinder 14 which is coupled eccentrically to head 8. By pulling on the head 8 in the direction of arrow D it is possible with rotation-driving cylinder 14 to bring about rotation of head 8 in the direction of arrow B. If head 8 is connected to frame part 12 with a screw connection, extension of the head 8 can be brought about by shortening the rotation-driving cylinder 14 in the direction of arrow D in FIG. 1. It is noted that teeth 9 are arranged on an inner ring 15 which is per se displaceable in the direction of arrow A relative to outer ring 16 of head 8. A safety function can hereby be realized, which will be further described hereinbelow, wherein outer ring 16 first comes to lie against package 10, only after which the teeth 9 on inner ring 15 are extended in order to perforate or cut through the sleeve 11 of package 10.

A cutter unit 17 is further arranged which can be driven with a cylinder 18 in a reciprocal movement as according to arrow E in FIG. 1 during driving by the cylinder 18.

The operations on package 10 with sleeve 11 are performed on a platform 19 with a fold, recess or deepened portion 20, in which the package 10 comes to lie for removal of sleeve 11.

Peeling unit 4 comprises peeling wheels 21 which are driven directly by motor 5 with belts 22. Peeling wheels 21 can be brought together in order to peel the sleeve 11 from package 10. Bringing together of peeling wheels 21 is indicated schematically in FIG. 1 with arrow F and is driven by a cylinder 23. For this purpose the arms 24 of peeling unit 4 are rotatable on drive shafts 25, which are per se connected to motor 5 in order to drive belts 22. The arrangement of belts 22 shown in FIG. 1 otherwise ensures downward discharge of peeled sleeves 11, for which purpose a collecting container (not shown) can be arranged under the device 1 shown here. In such a situation, wherein sleeve 11 is peeled from a package 10, the piston rod 32 of pusher cylinder 6 must of course be retracted.

The clamp 2 comprises a stop 26 which can be moved up and downward in the direction of arrow G through driving by cylinders 27. The force of stop 26 exerted on package 10 by cylinder 27 is preferably limited such that the content of package 10 is displaceable to some extent in sleeve 11, while the sleeve 11 itself is held fast by clamp 2. For this purpose use can for instance be made of a rubber covering 28 on the side of stop 26 directed toward package 10. As a result of the friction exerted by rubber covering 28 the sleeve remains stationary when the content of package 10 is displaced to the left or right.

The operation of the device shown in FIGS. 1 and 2 will be elucidated hereinbelow with a number of schematic views.

FIG. 3 shows a lift 29 with which one package 10 at a time can be carried up along wall 30. Package 10 then rolls over slope 31 to a flap 45, which is pulled out of the way at a suitable moment by cylinder 45 in order to cause package 10 to drop onto platform 19. More particularly the package 10 comes to lie in the recess or fold 20 in platform 19.

The actual unpacking of package 10, and thus the removal of sleeve 11 therefrom, can then take place.

Figure 4:
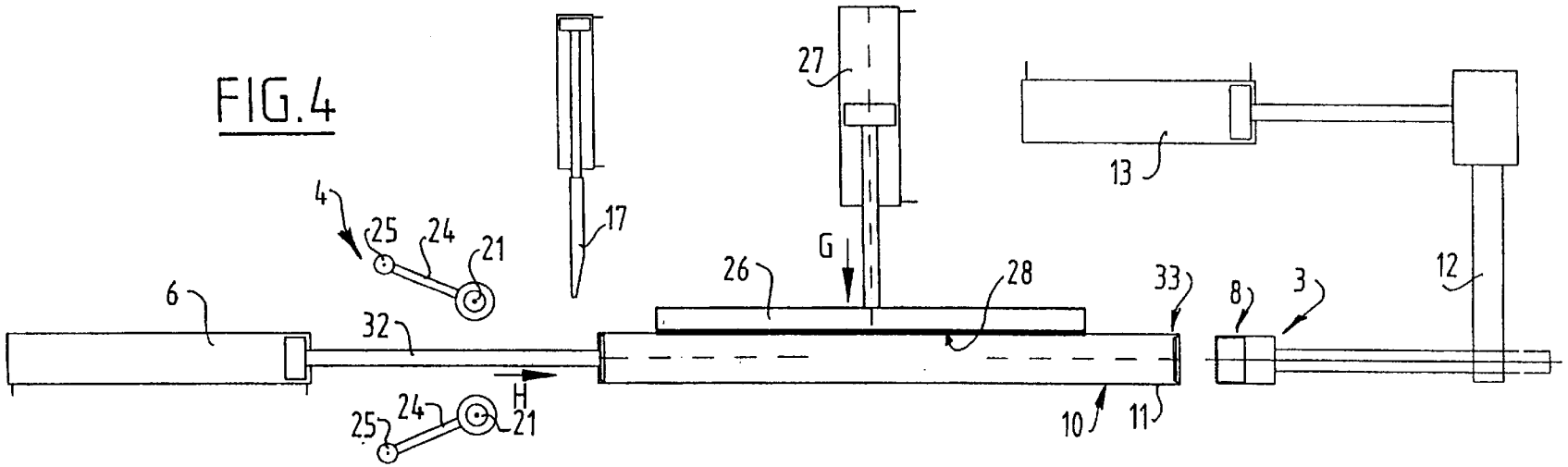

As shown in FIG. 4, a start is made herewith by extending the piston rod 32 of pusher cylinder 6 in the direction of arrow H. Prior hereto the stop 26 is lowered, wherein the rubber covering 28 on the side of stop 26 directed toward package 10 engages the sleeve 11 and holds it stationary. Cylinder 27 is lowered in the direction of arrow G for this purpose.

Because piston rod 32 pushes the contents of package 10 in sleeve 11 in the direction of arrow H up to the longitudinal end 33 of package 10 where perforator 3 is situated, sleeve 11 is pulled taut over the longitudinal end 33 due to the pushing up of contents 10. The operation of perforator 3, which follows and will be described below, is hereby improved.

Figure 5B:
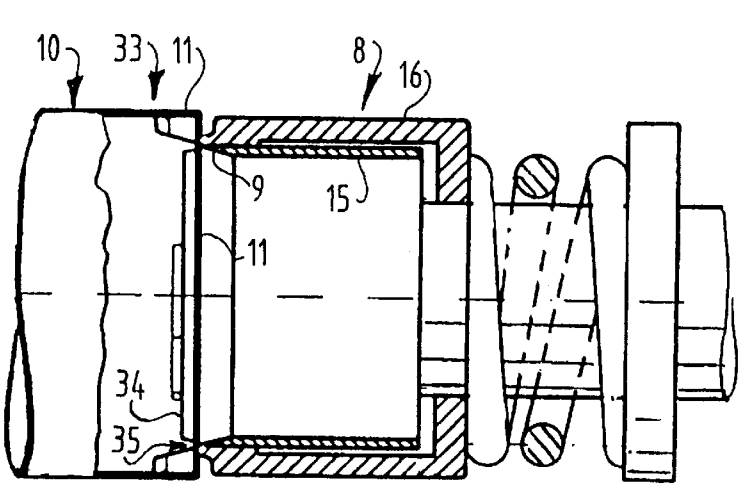
Figure 5A:
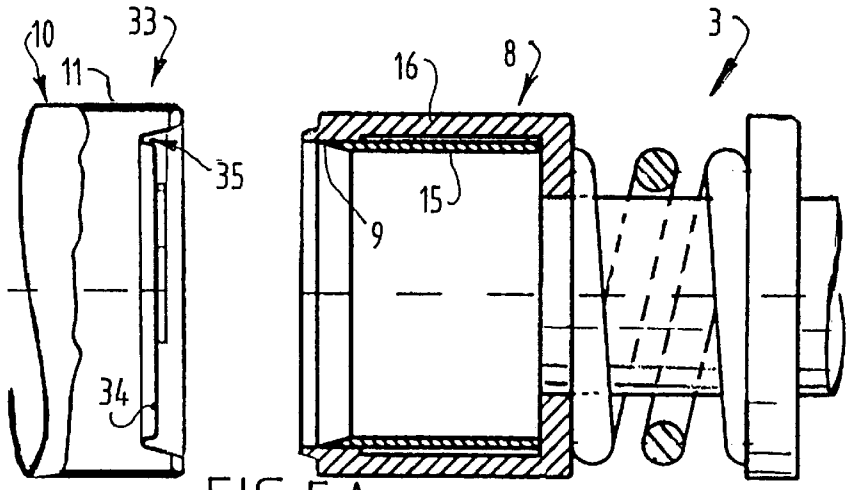

As shown in FIG. 5*a*, the design of outer ring 16, and therefore also of inner ring 15, is adapted to the specific embodiment of a package 10 having covers for drinks cans therein. A safety function is hereby realized. If the profile 34 of a can cover is facing in the correct direction, a groove 35, which is annular, is remote from the teeth 9 on inner ring 15. When head 8 is displaced forward in the direction of longitudinal end 33 of package 10 while sleeve 11 is stretched tautly thereover, this being described with reference to FIG. 4, the outer ring 16 fits partly into groove 35 with a shoulder 36. Only when this position has been reached is movement of the inner ring 15 with teeth 9 thereon enabled.

On the other hand, as shown in FIG. 5*b*, this movement is not enabled if the can covers lie in the opposite orientation in sleeve 11, as is shown in FIG. 5*b*. Outer ring 16 cannot penetrate into the annular grooves 35 of the profile 34 of the can covers, so that the movement of inner ring 15 with the teeth thereon does not come about either. An alarm function is preferably coupled hereto, so that an employee can intervene to remove the roll or makes use of an automated option to remove or reverse the package 10.

Figure 6:
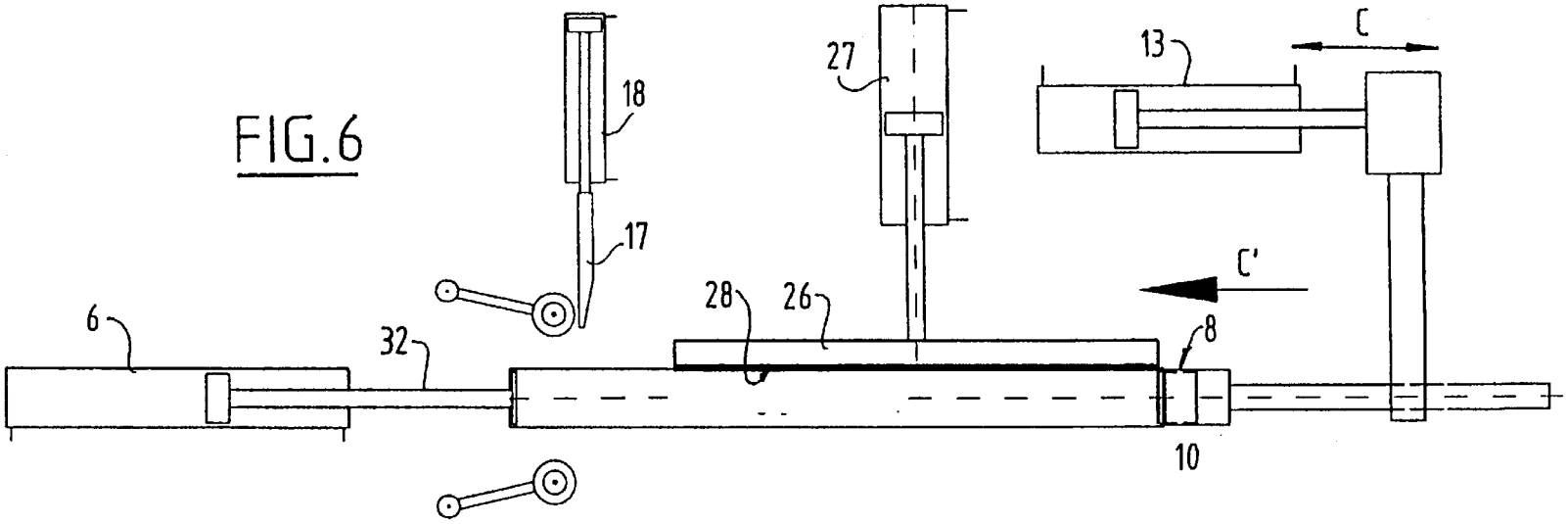

In the embodiment shown here perforations are only arranged with the head in longitudinal end 33 of sleeve 11 of package 10. As shown in FIG. 6, cylinders 27 of clamp 2 and pusher cylinder 6 are then released, i.e. deactivated, whereafter drive cylinder 13 is activated for movement of head 8 in the direction of arrow C so as to displace head 8 to the left in FIG. 6. Because cylinders 27 and pusher cylinder 6 have been deactivated, they do not form an obstruction. Head 8 thus carries package 10 along in its movement to the left in FIG. 6. Only a minimal stroke is hereby required for good operation of pusher cylinder 6, which enhances simplicity.

Figure 7:
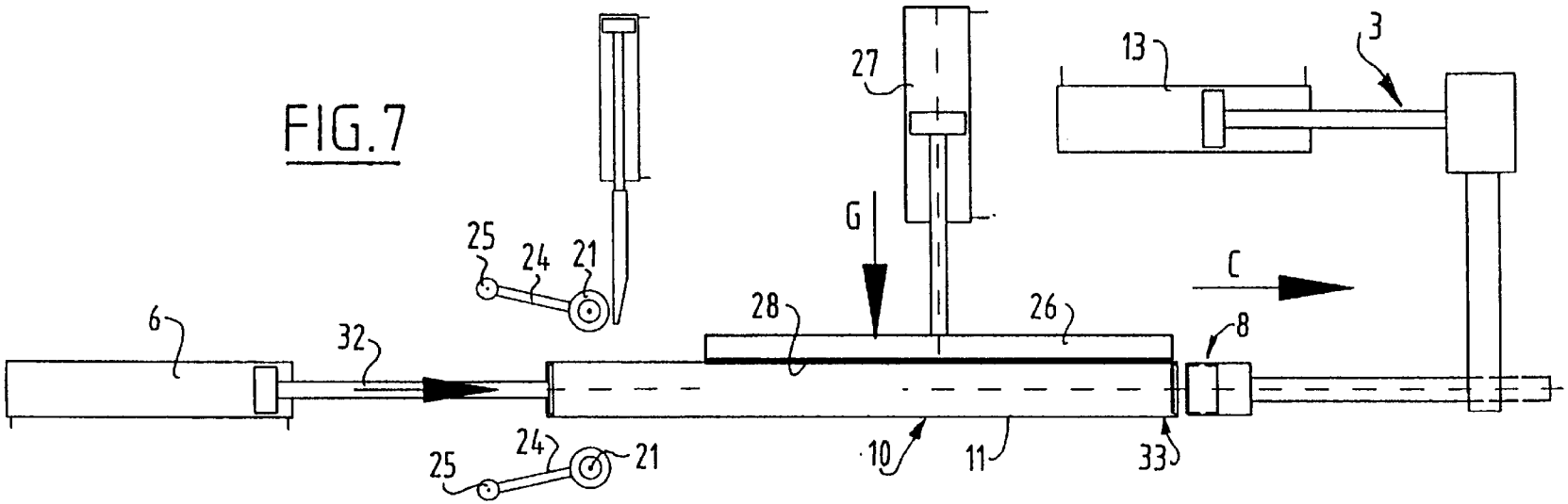

As shown in FIG. 7, drive cylinder 13 for the head 8 of perforator 3 is then deactivated, and cylinder 27 of clamp 2 is activated, only after which the pusher cylinder 6 is also activated again. This is indicated schematically in FIG. 7 with arrows C, G, H in alphabetical order. The contents of package 10 are pressed out of sleeve 11 at the longitudinal end 33 thereof by holding the sleeve 11 fixedly with stop 26 and pushing up the piston rod 32 of pusher cylinder 6 in the direction of arrow H. In the case of a stack of can covers in sleeve 11 the head 8 moves only very slowly sideward to the right in FIG. 7 in order to prevent the possibility of the covers at the longitudinal end 33 of the stack being pushed out of sleeve 11 falling over. At the end of sleeve 11 situated opposite longitudinal end 33 there is hereby simultaneously created a free part of sleeve 11 without the content of the package 10 herein for the purpose of engagement by peeling wheels 21.

Peeling wheels 21 have a form as shown in FIG. 7*a*. These peeling wheels 21 comprise a radial recess 36 whereby peeling wheels 21 can engage onto sleeve 11 round the piston rod 32 of pusher cylinder 6, whereafter the piston rod 32 of pusher cylinder 6, as shown in FIG. 8, can be retracted in the direction of arrow H from the engagement between wheels 21.

Peeling wheels 21 can subsequently be driven by setting motor 5 into operation and the sleeve 11 can be peeled away after cylinders 27 of clamp 2 have been deactivated in the direction of arrow G. Perforator 3 is herein also placed at a distance, as also shown in FIG. 8. The platform 19 is preferably placed at an angle, wherein the end at the side of perforator 3 is higher than on the side of peeling unit 4. This prevents the products in the package falling over during peeling of sleeve 11, which would be particularly-undesirable in the case of drinks can covers. Additionally or alternatively the perforator 3, and in particular the head 8 thereof, can be held in the vicinity of the longitudinal end of package 10 to prevent tipping over of for instance drinks can covers.

The peeling of sleeve 11 is shown schematically in FIG. 9. Peeling wheels 21 are driven as long as a sleeve 11 is still present round package 10. A schematically shown photo-detector 37 detects the presence of sleeve 11 and generates a signal indicating that the driving of peeling wheels 21 can be ended when the sleeve has been completely peeled.

During the removal of sleeve 11, and therefore during driving of peeling wheels 21, the peeling wheels, and more particularly arms 24, are moved intermittently away from and toward each other. This effectively prevents sleeve 11 crumpling during peeling thereof with peeling wheels 21. This would result in the sleeve 11 of package 10 being able to twist out of the recess 20 in platform 19. This would be particularly adverse for the discharge of the contents of package 10, such as the drinks can covers, but is efficiently prevented by intermittently opening and closing the space between peeling wheels 21.

Figure 10:
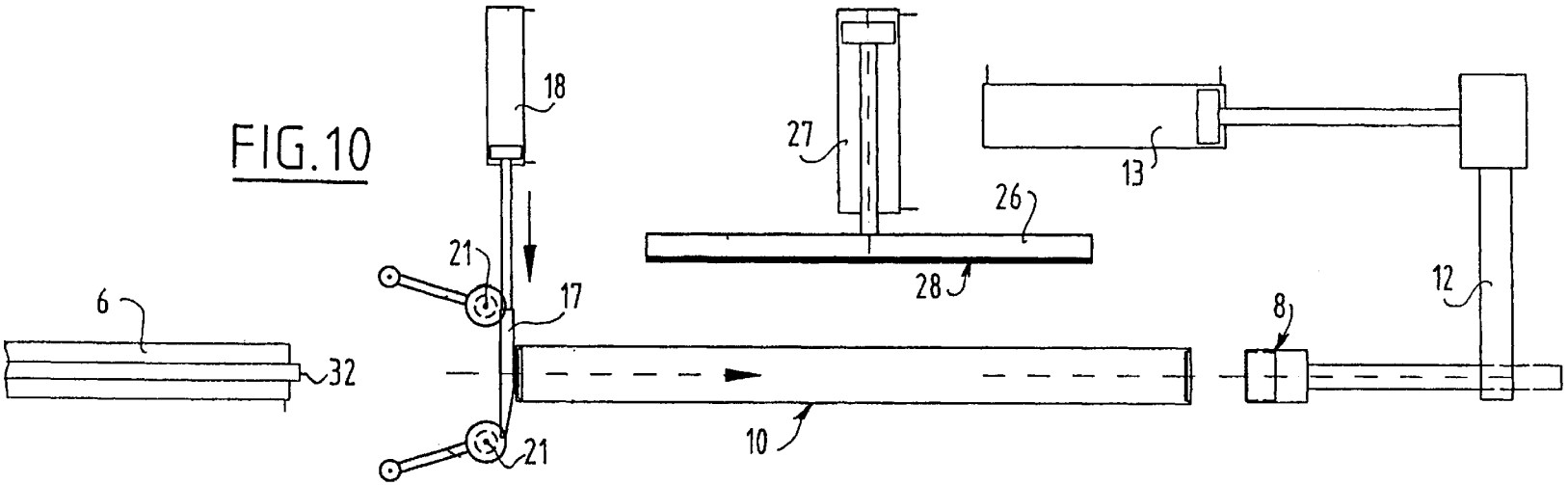
Figure 11:
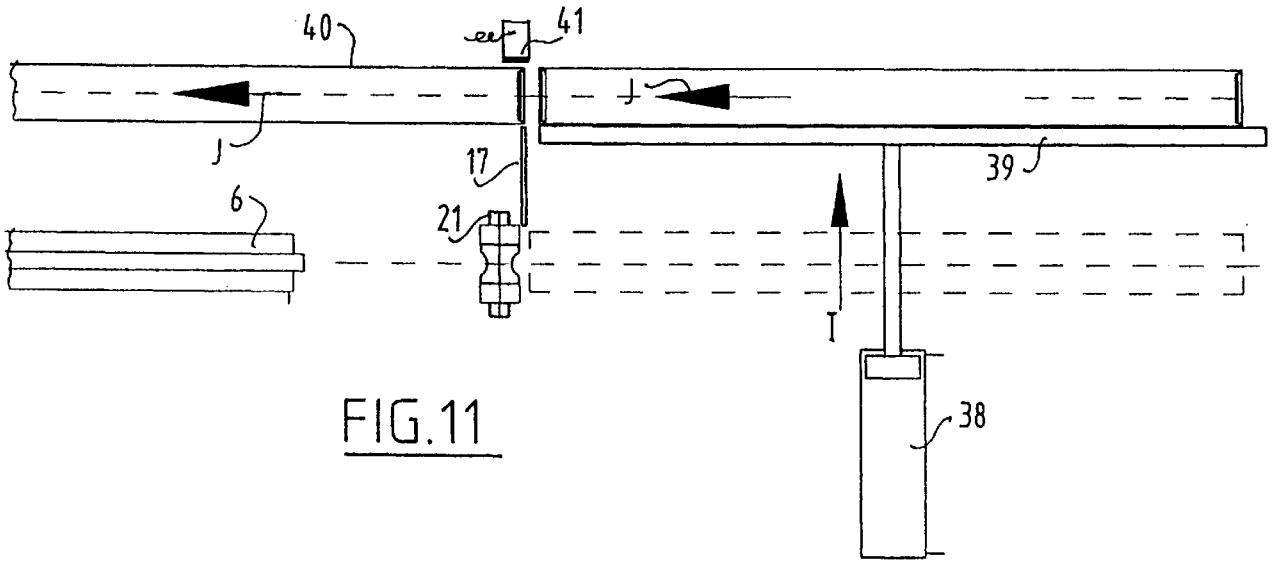

FIG. 10 shows the manner in which the cutter unit 17 descends in front of the contents of the removed sleeve 11 of package 10. It is noted that sleeve 11 is discharged downward between the belts 22 in FIG. 1 to a waste container, which is not further shown. Cutter unit 17 descends in front of the contents of package 10 when peeling wheels 21 move apart in order to thus hold together the contents of package 10. As described with reference to FIG. 9, wheels 21 move apart only when photo-detector 37 has detected that the whole sleeve 11 of package 10 has been peeled away. As also described above, the head 8 of perforator 3 can fit more closely onto the contents of package 10 than is shown in FIG. 10 in order to hold these contents together between this head 8 and cutter 17. This is particularly advantageous in the case of a content consisting of a plurality of items, such as drinks can covers. The unpacked content of package 10 can then be transferred in the manner shown in FIG. 11 to a discharge conveyor 40 using a slide 39, which is driven by a cylinder 38 in the direction of arrow I.

The operation of cylinder 38 is only enabled once a detector 41 has detected that a previously unpacked content of a package has shifted up sufficiently through processing thereof to allow space to the just unpacked content of a package 10. Further processing of the content of the packages then continues in the direction of arrow J, wherein the process of unpacking other packages 10 restarts to remove sleeves 11 therefrom.

It is noted that discharge conveyor 40 is positioned at the front of device 1 in the view of FIG. 1. As shown in FIG. 3, the packages 10 to be unpacked are supplied from the rear in the view of FIG. 1 for removal of sleeve 11 thereof.

It is noted that many additional and alternative embodiments will occur to the skilled person after perusal of the foregoing relating to the present invention. The sequence of FIGS. 6 and 7 can thus be omitted if a choice is made for a pusher cylinder 6 with a sufficiently long stroke. This is per se less advantageous however in respect of the space required for device 1 and the complexity of the components, particularly pusher cylinder 6, which must be able to make a longer stroke. Such an option nevertheless lies within the scope of the present invention. The peeling progression during removal of sleeve 11 of package 10 can also take place in a random other embodiment. After the removal of the longitudinal end of sleeve 11, the released edges of sleeve 11 can thus be engaged and the sleeve pulled back over itself for peeling thereof. The sleeve does not herein have to be cut or severed in longitudinal direction of package 10, and those risks involving damage to the content of package 10 are avoided.

What is claimed is:

1. A device for unpacking a stack of products packaged in a sleeve, such as a stack of covers for cans, for instance drinks cans, comprising:

means for removing a portion of the sleeve located on a longitudinal end;

means for peeling away the sleeve over the stack with a relative movement of the stack and the sleeve; and means for separately discharging the stack without the sleeve.

2. The device as claimed in claim 1, wherein the means for removing the portion of the sleeve comprise:

means for tensioning the sleeve on the longitudinal end; and means for cutting into the tensioned sleeve on the longitudinal end.

3. The device as claimed in claim 2, wherein the means for tensioning the sleeve comprise:

means for fixing the sleeve; and means for pushing the stack in the fixed sleeve up against the longitudinal end of the sleeve.

4. The device as claimed in claim 1, wherein the means for removing the portion of the sleeve comprise means for perforating the longitudinal end thereof.

5. The device as claimed in claim 4, wherein the means for perforating comprise means for arranging notches in the sleeve in a radial pattern on the longitudinal end thereof.

6. The device as claimed in claim 4, wherein the means for removing the portion of the sleeve further comprise:

means for fixing the sleeve; and means for pushing the stack through the longitudinal end.

7. The device as claimed in claim 3, comprising means for releasing the sleeve and displacing the sleeve having the stack therein in the direction of the end of the sleeve located opposite the longitudinal end between the pushing against the longitudinal end of the sleeve and the pushing through the longitudinal end.

8. The device as claimed in claim 3, wherein the means for fixing the sleeve comprise a clamp.

9. The device as claimed in claim 8, wherein the clamp comprises a covering engaging the material of the sleeve with friction.

10. The device as claimed in claim 1, wherein the means for peeling the sleeve comprise: means for engaging a part of the sleeve extending beyond the stack with a set of rotatable wheels which can be moved away from and toward each other by bringing together the wheels having therebetween the protruding part of the sleeve, and driving the wheels in mutually opposing rotation.

11. The device as claimed in claim 10, further comprising means for intermittently moving the wheels respectively away from and toward each other during driving of the wheels.

12. The device as claimed in claim 10, wherein the wheels are roller-shaped, are smooth and rigid in the central portion thereof, and close to the outer portions thereof wholly or partly comprise an element engaging the material of the sleeve with friction.

13. A method for unpacking a stack of products packaged in a sleeve, such as a stack of covers for cans, for instance drinks cans, with a device according to claim 1, comprising of:

removing a part of the sleeve located on a longitudinal end, peeling away the sleeve over the stack with a relative movement of the stack and the sleeve; and separately discharging the stack without the sleeve.

14. The method as claimed in claim 13, wherein removal of the portion of the sleeve comprises of:

tensioning the sleeve over the stack on the longitudinal end; and cutting into the tensioned sleeve on the longitudinal end.

15. The method as claimed in claim 14, wherein tensioning of the sleeve comprises of:

fixing the sleeve; and pushing the stack in the fixed sleeve up against the longitudinal end of the sleeve.

16. The method as claimed in claim 13, wherein removal of the portion of the sleeve comprises perforating the longitudinal end thereof.

17. The method as claimed in claim 16, wherein perforating comprises of arranging notches in the sleeve in a radial pattern on the longitudinal end thereof.

18. The method as claimed in claim 17, wherein the products comprise a recess corresponding with the pattern of notches, and further comprising safety means which check alignment of the notches and the recess and only allow arranging of the notches when the alignment is correct.

19. The method as claimed in claim 16, wherein removal of the portion of the sleeve further comprises of:

fixing the sleeve; and pushing the stack through the longitudinal end.

20. The method as claimed in claim 15, comprising of releasing the sleeve and displacing the sleeve having the stack therein in the direction of the end of the sleeve located opposite the longitudinal end between the pushing against the longitudinal end of the sleeve and the pushing through the longitudinal end.

21. The method as claimed in claim 13, wherein peeling of the sleeve comprises of: engaging a part of the sleeve extending beyond the stack with a set of rotatable wheels which can be moved away from and toward each other by bringing together the wheels having therebetween the protruding part of the sleeve, and driving the wheels in mutually opposing rotation.

22. The method as claimed in claim 21, further comprising of intermittently moving the wheels respectively away from and toward each other during driving of the wheels.

23. The device as claimed in claim 6, comprising means for releasing the sleeve and displacing the sleeve having the stack therein in the direction of the end of the sleeve located opposite the longitudinal end between the pushing against the longitudinal end of the sleeve and the pushing through the longitudinal end.

24. The device as claimed in claim 6, wherein the means for fixing the sleeve comprise a clamp.

25. The method as claimed in claim 18, comprised of releasing the sleeve and displacing the sleeve having the stack therein in the direction of the end of the sleeve located opposite the longitudinal end between the pushing against the longitudinal end of the sleeve and the pushing through the longitudinal end.

* * * * *